US010309400B2

(12) United States Patent
Affaticati

(10) Patent No.: US 10,309,400 B2
(45) Date of Patent: Jun. 4, 2019

(54) VOLUMETRIC COMPRESSOR

(71) Applicant: SCOPREGA S.p.A., Cassano D'adda (IT)

(72) Inventor: Artemio Affaticati, Cadeo (IT)

(73) Assignee: SCOPREGA S.P.A., Cassano D'Adda (IT)

( * ) Notice: Subject to any disclaimer, the term of this patent is extended or adjusted under 35 U.S.C. 154(b) by 81 days.

(21) Appl. No.: 15/505,408

(22) PCT Filed: Sep. 4, 2015

(86) PCT No.: PCT/IB2015/056764
§ 371 (c)(1),
(2) Date: Feb. 21, 2017

(87) PCT Pub. No.: WO2016/035047
PCT Pub. Date: Mar. 10, 2016

(65) Prior Publication Data

US 2017/0254330 A1 Sep. 7, 2017

(30) Foreign Application Priority Data

Sep. 4, 2014 (IT) ..... BO2014A0483

(51) Int. Cl.

| | |
|---|---|
| ***F01C 11/00*** | (2006.01) |
| ***F03C 2/00*** | (2006.01) |
| ***F03C 4/00*** | (2006.01) |
| ***F04C 23/00*** | (2006.01) |
| ***F04C 28/02*** | (2006.01) |
| ***F04C 18/12*** | (2006.01) |
| ***F04C 29/12*** | (2006.01) |

(52) U.S. Cl.
CPC ..... *F04C 23/001* (2013.01); *F04C 18/126* (2013.01); *F04C 28/02* (2013.01); *F04C 29/12* (2013.01); *F04C 2240/30* (2013.01)

(58) Field of Classification Search
CPC ..... F04C 23/001; F04C 2/082; F04C 2/084; F04C 2/086; F04C 28/02; F04C 29/12; F04C 18/08; F04C 18/082; F04C 18/084; F04C 18/086; F04C 18/126; F04C 2240/30
USPC ..... 418/9, 15, 131–132, 206.1–206.9
See application file for complete search history.

(56) References Cited

U.S. PATENT DOCUMENTS 3,198,120 A * 8/1965 Little, Jr. ..... F04C 2240/30 418/70
3,667,874 A * 6/1972 Weatherston et al. ..... F04C 23/001 418/9
3,837,764 A 9/1974 Fritch et al.
(Continued)

FOREIGN PATENT DOCUMENTS

| | | |
|---|---|---|
| EP | 0 730 093 | 9/1996 |
| EP | 2 336 675 | 6/2011 |

*Primary Examiner* — Theresa Trieu
(74) *Attorney, Agent, or Firm* — Leason Ellis LLP

(57) ABSTRACT

A two-stage rotary compressor for gas, in particular air. The compressor comprises a bottom plate and a head enclosing between them two compression stages. The compressor is characterized in that an interconnection device is arranged between the two compression stages, said device being suited to establish a communication "in series" or "in parallel", to be selected by the manufacturer, between said two compression stages.

9 Claims, 7 Drawing Sheets

(56) References Cited

U.S. PATENT DOCUMENTS

| | | | | |
|---|---|---|---|---|
| 4,127,364 | A * | 11/1978 | Eiermann | F04C 2/102 418/171 |
| 4,295,794 | A | 10/1981 | Cain | |
| 2005/0089424 | A1* | 4/2005 | Liu | F04C 23/001 418/9 |
| 2006/0228242 | A1 | 10/2006 | West et al. | |
| 2008/0226482 | A1 | 9/2008 | Zhou et al. | |
| 2011/0027118 | A1* | 2/2011 | Milovanovic | F04C 2/084 418/206.5 |
| 2011/0179822 | A1* | 7/2011 | Sotojima | F04C 23/001 418/9 |

* cited by examiner

VOLUMETRIC COMPRESSOR

CROSS REFERENCE TO RELATED APPLICATIONS

The present application is a U.S. National Phase of International Patent Application PCT/IB2015/056764, filed on Sep. 4, 2015, which claims priority to Italian Application No. BO2014A000483, filed on Sep. 4, 2014, each of which is incorporated by reference as if expressly set forth in their respective entireties herein.

TECHNICAL FIELD

The present invention relates to an electric volumetric Roots-type compressor for gas, in particular air.

In particular, the present invention finds advantageous, but not exclusive application to inflate inflatable boats, kite surfing, SUP (acronym for: "Stand Up Paddling") boards, to which the following description will make explicit reference without thereby losing generality.

In particular, the teaching of the present invention advantageously, but not exclusively, applies to a two-stage Roots-type compressor to which explicit reference will be made.

BACKGROUND ART

As already known, in camping and activities that generally take place during leisure time you often need to inflate a device, such as, for example, rafts, kitesurfing boards, etc. Beside traditional foot pumps, or manual pumps, the use of electric compressors is increasingly widespread.

The traditional technology of electric compressors for this type of use contemplates the adoption of an electric turbine plus a piston compressor.

While having undoubted advantages with regard to inflation time and reached pressure, the electric compressors currently on the market disadvantageously have a low energy efficiency; moreover, they are very noisy, thus having a disturbing effect in resting places such as campgrounds, beaches etc.

DISCLOSURE OF INVENTION

Therefore, the main object of the present invention is to provide a two-stage Roots-type air compressor, free from the aforesaid drawbacks and, at the same time, having a simple and economical manufacture.

Furthermore, as already known, some special uses require high pressure compressed air with a limited flow rate, as in the case of inflatable boats, kayaks and mattresses, whereas other uses require high flow rates at low pressure, as in the case of kites and SUP boards.

Consequently, two different lines for industrially manufacturing two different models should be created to obtain these two types of compressors.

Therefore, it would be useful to conceive and design a two-stage Roots-type air compressor where the two types of compressors could respectively be obtained with the same structural elements (although differently assembled), at the manufacturer's choice according to the market demand; namely a first model at high outlet pressure and with a limited flow rate, and a second model allowing to obtain high flow rates at low outlet pressures.

Therefore, the present invention provides a two-stage compressor as claimed in claim 1 or in any one of the claims directly or indirectly dependent from said claim 1.

BRIEF DESCRIPTION OF THE DRAWINGS

For a better understanding of the present invention, it is now described a preferred embodiment, purely by way of non-limiting example and with reference to the accompanying drawings, wherein.

BEST MODE FOR CARRYING OUT THE INVENTION

Figure 1:
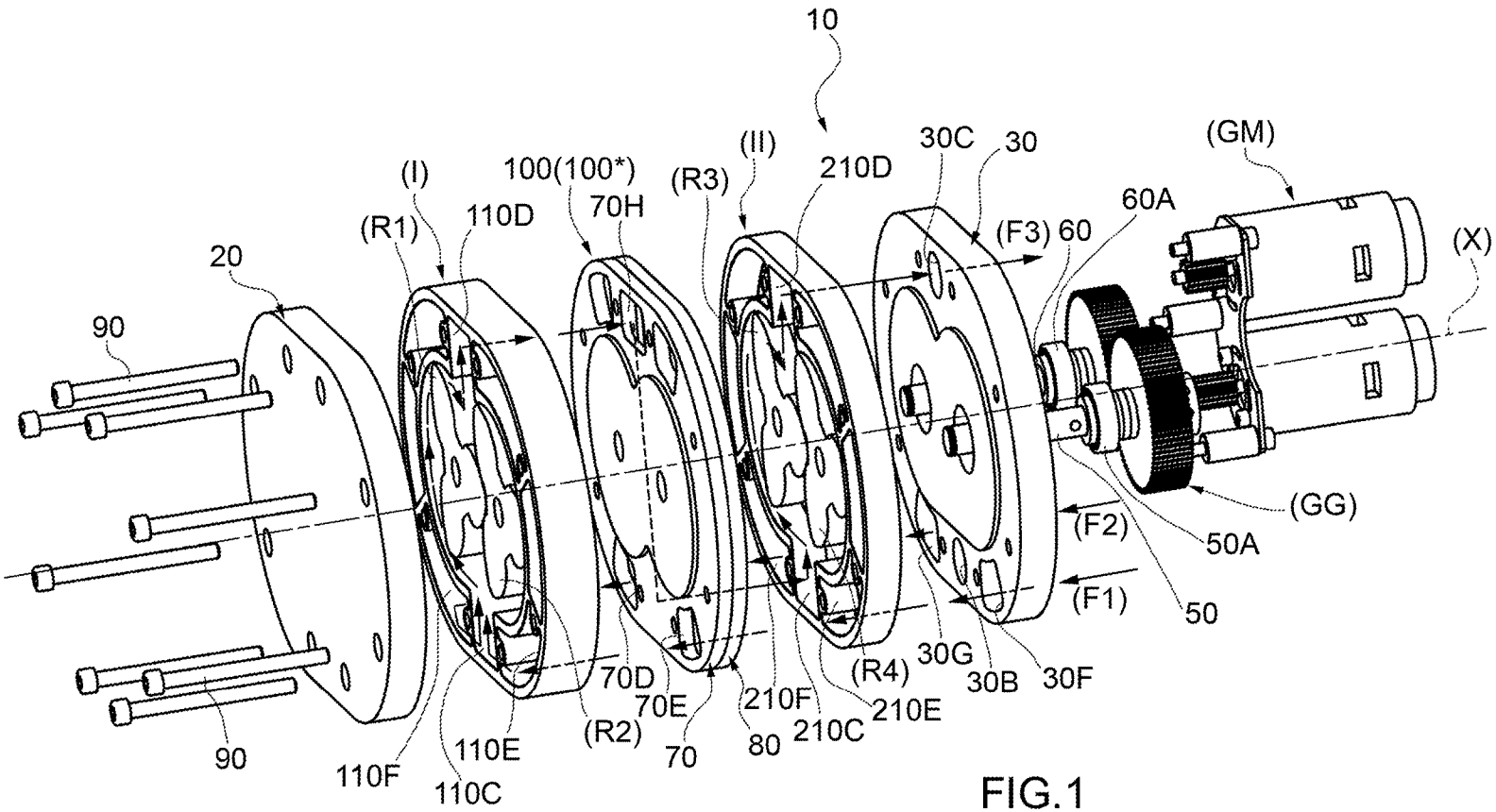
FIG. 1 shows an exploded view of a first configuration (with the two stages connected "in series") of the two-stage compressor of the present invention.

In FIG. 1, 10 indicates, as a whole, a two-stage Roots-type rotary air compressor manufactured according to the teaching of the present invention.

The compressor 10 comprises a bottom plate 20 and a head 30. As shown in FIG. 1, a motor (GM) mounted on the side of the head 30 sets in rotation two drive shafts 50 and 60 by using a group of gears (GG) with known systems.

From the macroscopic point of view, the compressor 10 has a substantially longitudinally symmetric axis (X), and it is thinkable as if it was divided into a first compression stage (I) and in a second compression stage (II) by means of a pair of dividing plates 70, 80.

Incidentally, as better seen later on, the two dividing plates 70 and 80 are identical. Their mutual positioning determines whether the two compression stages (I) and (II) are connected "in series", or "in parallel" (see below).

The combination of the two dividing plates 70 and 80 forms an interconnection device 100 between the two compression stages (I) and (II).

Figure 4:
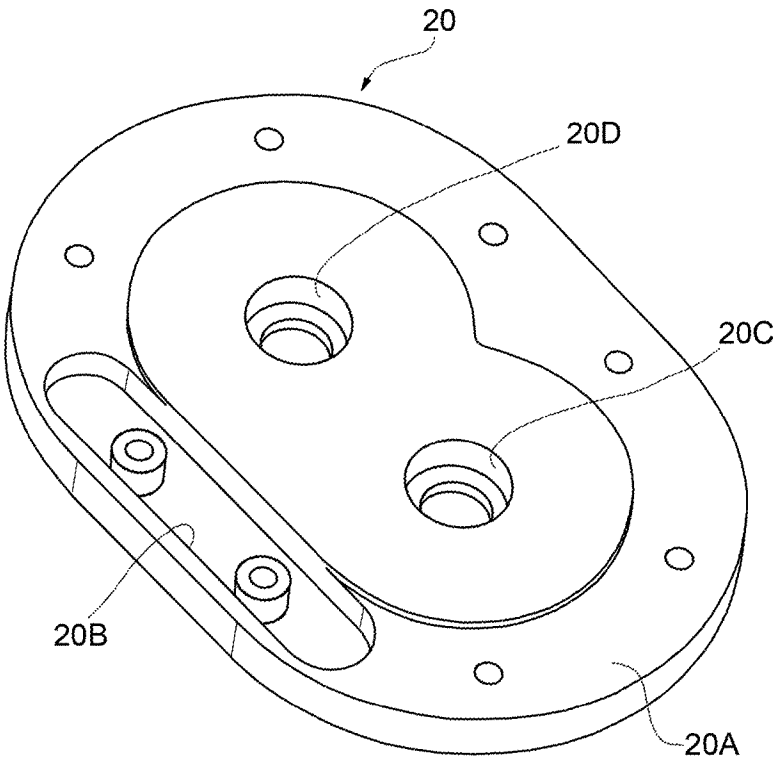
FIG. 4 shows a three-dimensional front view of the lid of FIG. 3.
Figure 3:
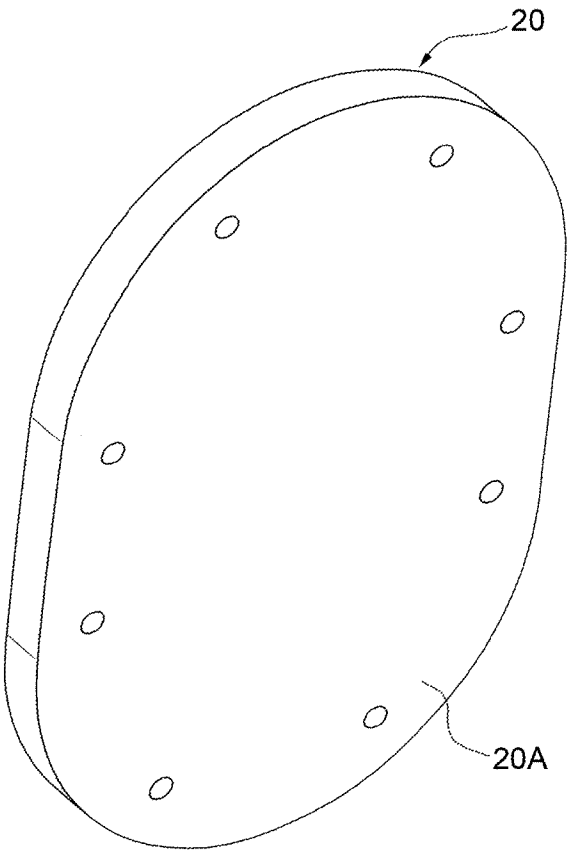
FIG. 3 shows a three-dimensional rear view of a lid used in the two-stage compressor manufactured according to the teaching of the present invention.

As shown in more detail in FIGS. 3, 4, the lid 20 comprises a main body 20A having a substantially ellipsoidal plate shape.

Eight through holes have been formed in the main body 20A, each of them being crossed in use by a respective tie rod 90 (FIG. 1), at least partially threaded, associated to a respective nut (not shown).

A groove 20B (FIG. 4) is arranged on the inner face of the main body 20A, facing the first compression stage (I).

As shown again in FIG. 4, also two seats 20C, 20D which, in use, accommodate respective end bearings (not shown) for supporting the shafts 50, 60, are arranged on the inner face of the main body 20A.

Figure 5:
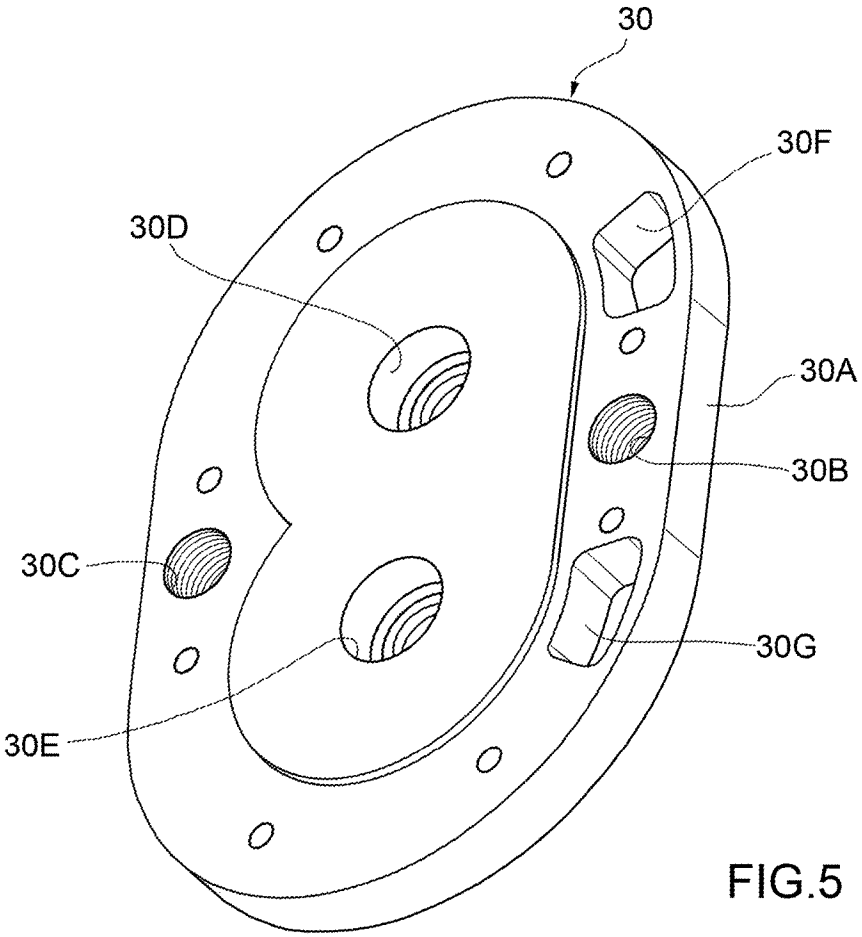
FIG. 5 shows a three-dimensional view of a head used in the two-stage compressor according to the present invention.

As shown in more detail in FIG. 5, the head 30 comprises, in turn, a main body 30A having a substantially ellipsoidal plate shape.

Eight through holes have been formed in the main body 30A, each of them being crossed in use by a respective tie rod 90 (FIG. 1).

FIG. 5 shows the following openings:

- two centrally arranged circular through holes 30B and 30C for air passage;
- two circular through holes 30D, 30E containing in use two bearings 50A, 60A which support the drive shafts 50, 60; and
- two slots 30F, 30G for air passage, symmetrically arranged with respect to the circular through hole 30B.

A substantially B-shaped projection is arranged on the face of the main body 30A facing the second compression stage (II), and it substantially follows the volute of the rotors of the second compression stage (II) (see below).

Figure 6:
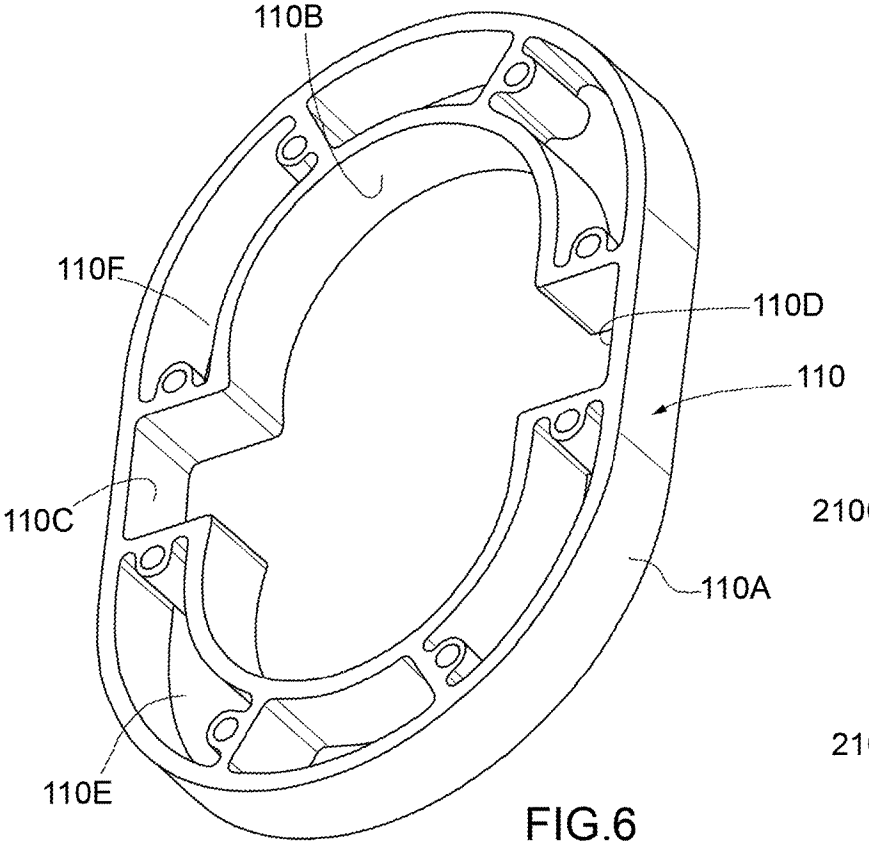
FIG. 6 shows a three-dimensional view of a first cage relative to a first compression stage of the two-stage compressor according to the invention.

With reference now to FIGS. 1, 6, the first compression stage (I) comprises a first cage 110 whose main body 110A also has a substantially ellipsoidal shape. The edge of the main body 110A follows the one of the main body 20A of the lid 20.

Moreover, the main body 110A (FIG. 6) has:

- an open central volute 110B receiving two lobe rotors (R1) and (R2) (FIG. 1);
- a lower opening 110C (FIG. 6) for air passage;
- an upper opening 110D (FIG. 6) for air passage; and
- two lower side slots 110E and 110F (FIG. 6) for air passage.

Figure 7:
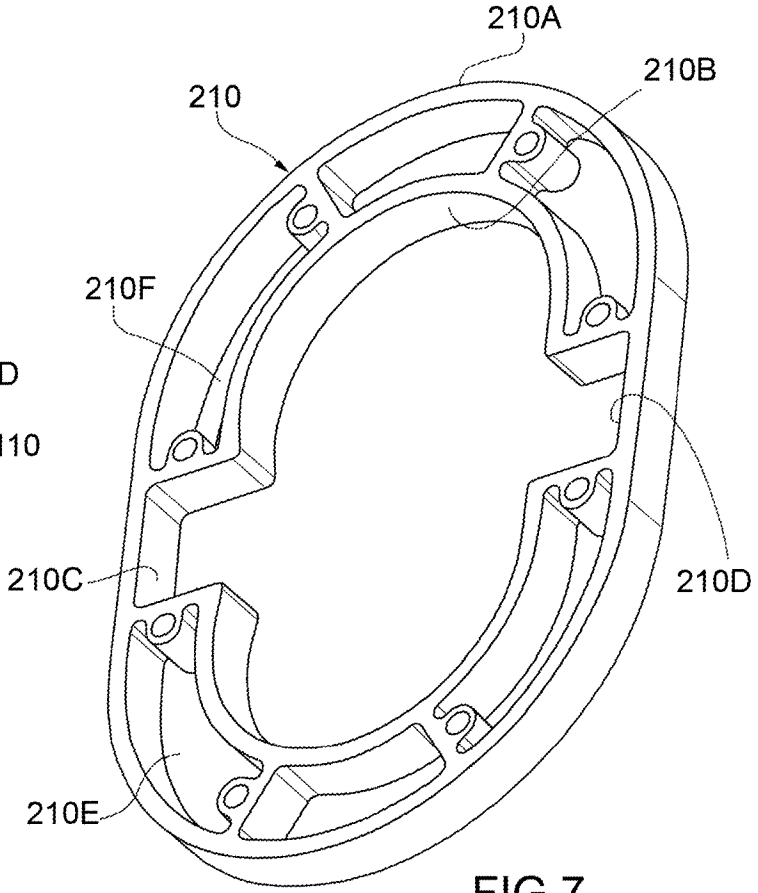
FIG. 7 shows a three-dimensional view of a second cage relative to a second compression stage of the two-stage compressor according to the invention.

Analogously, the second compression stage (II) (FIGS. 1, 7) comprises a second cage 210 whose main body 210A also has a substantially ellipsoidal shape. The edge of the main body 210A follows the one of the main body 30A of the head 30 (FIG. 1).

Furthermore, the main body 210A has:

- an open central volute 210B receiving two lobe rotors (R3) and (R4) (FIG. 1);
- a lower opening 210C (FIG. 7) for air passage;
- an upper opening 210D (FIG. 7) for air passage; and
- two lower side slots 210E and 210F (FIG. 7) for air passage.

The edges of all the openings and of the two volutes formed on the main bodies 110A, 210A are surrounded by ribs.

In the embodiment shown in FIG. 1, the thickness of the main bodies 110A, 210A (FIGS. 6, 7) is different because, as later described, the two compression stages (I) and (II) can have different flow rates. However, nothing prevents the two compression stages (I), (II) from having the same thickness.

Each main body 110A, 210A also has eight through holes which, in use, are crossed by the aforesaid tie rods 90 (FIG. 1).

As previously stated, the device 100 for the interconnection between the two compression stages (I) and (II) comprises the two identical dividing plates 70 and 80.

As better seen later on, the two compression stages (I) and (II) are interconnected "in series" or "in parallel" depending on how the two dividing plates 70 and 80 are connected in the interconnection device 100 (see below).

Figure 8:
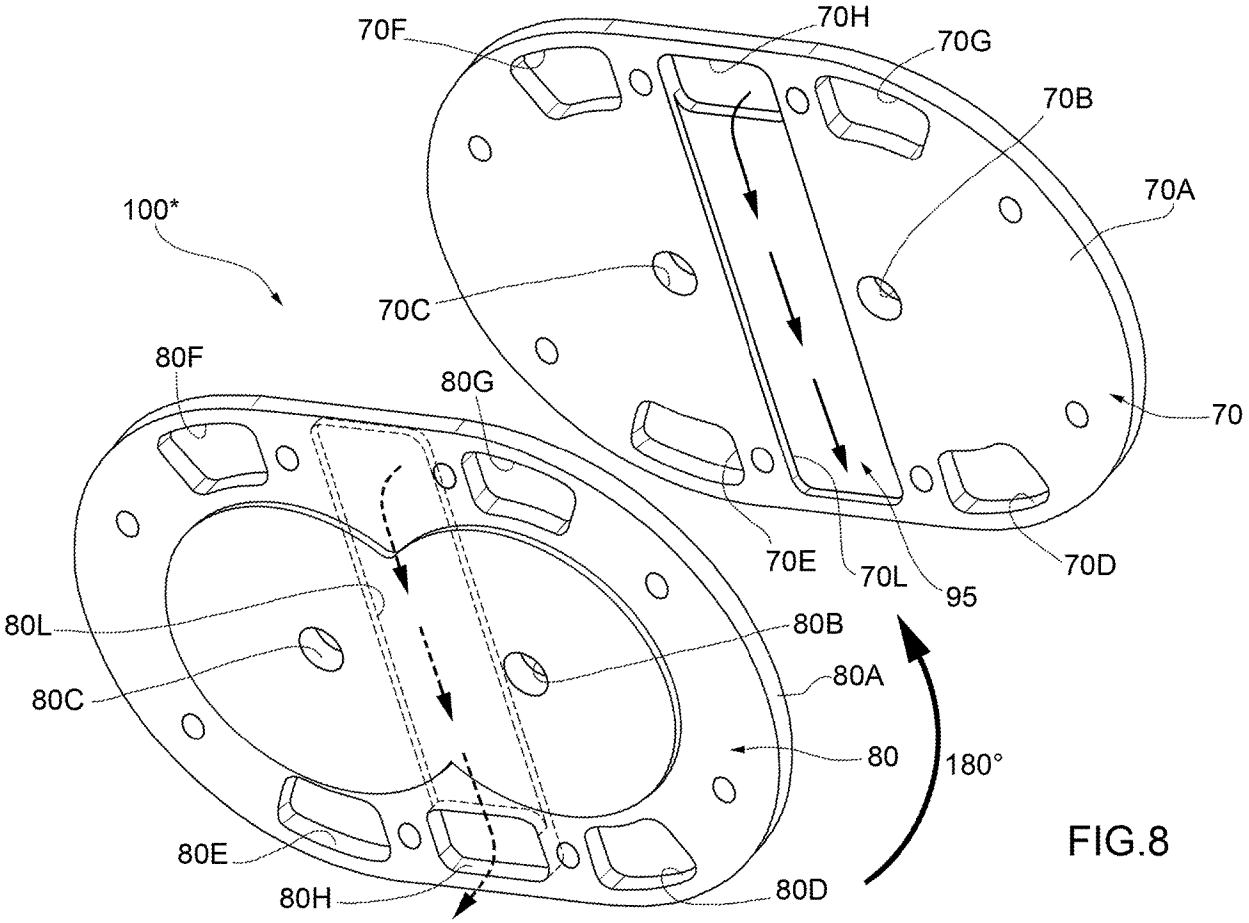
FIG. 8 shows a first configuration of two dividing plates comprised in a device for the interconnection of the two compression stages.

As an example of the two forms of connection ("in series", or "in parallel") of the two compression stages (I), (II), FIG. 8 shows an interconnection device 100* when the two dividing plates 70 and 80 are connected "in series".

Figure 9:
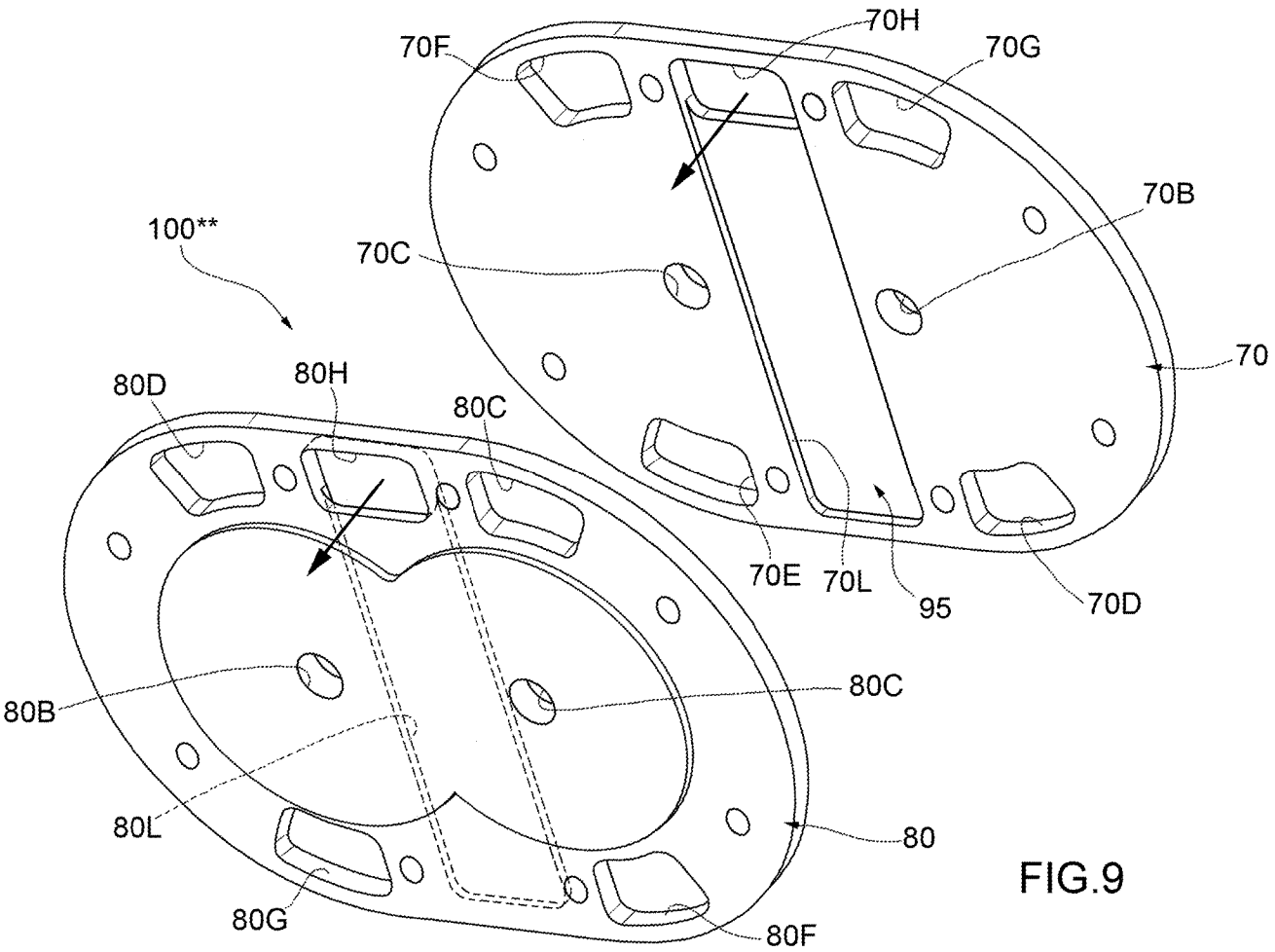
FIG. 9 shows a second configuration of the two dividing plates of FIG. 8.

On the other hand, FIG. 9 shows the configuration in which the two dividing plates 70 and 80 are connected "in parallel", thus forming an interconnection device 100**.

As shown in more detail in FIGS. 8, 9, the dividing plate comprises a main body 70A having a substantially ellipsoidal shape.

Two central through holes 70B, 70C, respectively corresponding to the aforesaid through holes 30D, 30E formed on the head 30, are formed on the main body 70A. The two central through holes 70B, 70C, in use, are also crossed by the two shafts 50, 60.

Four slots 70D, 70E, 70F, 70G are arranged close to the edge of the main body 70A, two of them corresponding in use to the slots 30F, 30G (FIG. 5).

An opening 70H having a substantially rectangular shape is arranged on the upper edge of the main body 70A, whereas a longitudinal rectangular recess 70L extending downwards on the centreline of the main body 70A is associated to said opening 70H.

The recess 70L is not a through hole and is actually a simple sunken portion of the plane of the main body 70A (see below). Analogously, the dividing plate 80 comprises a main body 80A having a substantially ellipsoidal shape.

Two central through holes 80B, 80C are formed on the main body 80A and correspond to said through holes 30D, 30E of the head 30. The two central through holes 80B, 80C are also crossed by the two shafts 50, 60.

Four slots 80D, 80E, 80F, 80G are arranged close to the edge of the main body 80A.

Centrally there is a through opening 80H, having a substantially rectangular shape, to which a longitudinal rectangular recess 80L extending on the centreline of the main body 80A is associated.

The recess 70L is not a through hole and is actually a simple sunken portion of the plane of the main body 80A (see below). Obviously, also the main bodies 70A and 80A have eight through holes crossed, in use, by the tie rods 90.

The various elements included in the two-stage rotary compressor 10 are packaged by means of the aforesaid partially threaded tie rods 90, each of which is provided with a respective nut (not shown).

In the embodiment illustrated in FIG. 9 (connection "in parallel"), the dividing plate 70 has not moved with respect to the configuration of FIG. 8, whereas the dividing plate of FIG. 8 has been ideally rotated by 180° counterclockwise (see arrow in FIG. 9).

The two plates 70, 80 are then packaged to form said interconnection device 100**.

While the head 30, the second cage 210 and the first cage 110 are all provided with two respective slots (30F, 30G; 210E, 210F; 110E, 110F), each dividing plate 70, 80 has four respective slots (70D, 70E, 70F, 70G, 80D, 80E, 80F, 80G). This is because, in the case of a connection "in series" (FIGS. 1, 8), the slot 80E must be aligned to the slot 70E (for the air inlet duct), whereas the slot 70D must be aligned to the slot 80D (air outlet duct).

On the other hand, in the case of a connection "in parallel" (FIGS. 2, 9) the slot 80G must be aligned to the slot 70E (for the air inlet duct), whereas the slot 70D must be aligned to the slot 80F (air outlet duct).

In the first case ("in series"—FIGS. 1, 8) the slots 80F, 80G, 70F, 70G are not crossed by any airflow; whereas in the second case ("in parallel"—FIGS. 2, 9) the slots 80D, 80C, 70F, 70G are not crossed by the air.

The operation "in series" of the two-stage rotary compressor of the present invention will now be described with reference to FIGS. 1 and 8.

In this case, the outside air to be compressed enters the compressor 10 through the slots 30F, 30G formed on the head 30.

Then the air flows through the lower side slots 210E and 210F formed in the plate 210 of the second compression stage (II), passing through the slots 70D and 70E and 80D and 80E which are respectively arranged on the dividing plates 70, 80 of the interconnection device 100*.

Therefore, in this case the air bypasses the second compression stage (II) to enter the first compression stage (I).

Therefore, the air enters the first compression stage (I) through the lower side slots 110E and 110F and, sliding in the groove 20B (FIG. 4) arranged inside the lid 20, is conveyed towards the lower opening 110C actually representing the inlet of the first compression stage (I).

Once compressed by the rotors (R1) and (R2), the air is sent to the upper opening 110D, which can be considered to all effects the outlet of the first compression stage (I).

Now the air passes through the opening 70H (FIG. 8) and finds the recess 70L which, together with the recess 80L of the dividing plate 80, forms a channel 95 having a rectangular cross section.

The air then flows downwards along the channel 95 and comes out of the through hole 80H to move towards the second compression stage (II) through the lower opening 210C, representing the inlet opening of said second compression stage (II).

The air is then compressed by the rotors (R3) and (R4), also rotated by the motor (GM), and exits through the upper opening 210D, representing the outlet opening of the second compression stage (II).

Finally, the air compressed in the two compression stages (I), (II) connected "in series" exits through the circular through hole 30C and is sent to a user device (not shown).

In FIG. 1, the airflows entering the two-stage compressor 10 have been indicated by the arrows (F1) and (F2), whereas the outlet airflow is indicated by the arrow (F3).

For example, in the case of a connection "in series", a flow rate of 400 nl/min at a pressure of 500 mbar is supposed in the first compression stage (I), whereas the air undergoes a further compression of 500 mbar in the second compression stage (II). As a result, the air exiting the compressor 10 has a flow rate of 250 nl/min at a pressure of 1000 mbar.

Figure 2:
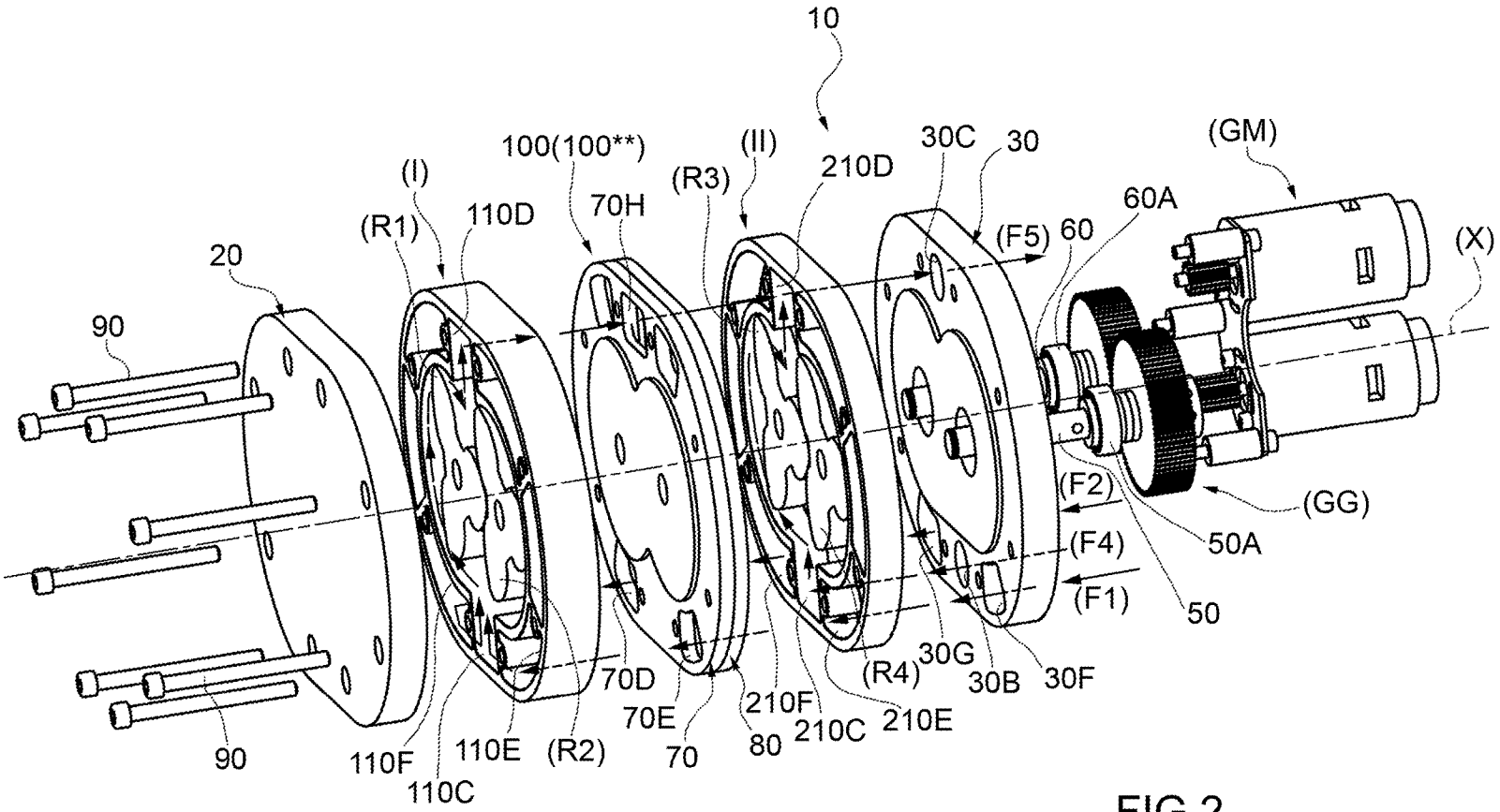
FIG. 2 shows an exploded view of a second configuration (with the two stages connected "in parallel") of the two-stage compressor of the present invention.

On the other hand, in the case of a configuration like the one shown in FIGS. 2, 9 ("in parallel"), the two openings 70H, 80H are disposed one after the other, and the compressed air exiting the first compression stage (I) flows directly towards the upper opening 210D of the second compression stage (II) and towards the circular outlet through hole 30C of the head 30.

In this case, as shown in FIG. 2, a further airflow fed only to the second compression stage (II) enters the through hole 30B also formed in the head 30. This second inlet flow rate, which is added to the first inlet flow rate passing through the two slots 30G, 30H, directly reaches the lower opening 210C (inlet opening) of the second compression stage (II) and, after the compression carried out by the two rotors (R3) (R4) (FIG. 1), is released through the outlet opening represented by the upper opening 210D.

In other words, the two flows from the first compression stage (I) and from the second compression stage (II) add up at the upper opening 210D. Both flows then come out through the circular through hole 30C and are sent to a user device (not shown).

In FIG. 2, the airflows entering the two-stage compressor 10 are indicated by arrows (F1), F2 (F4), whereas the outlet airflow is indicated by the arrow (F5).

For example, in the case of a connection "in parallel", it can be assumed that 300 nl/min of air at a pressure of 400 mbar enter the first compression stage (I), whereas 200 nl/min of air at a pressure of 400 mbar enter the second compression stage (II). Therefore, a total air flow rate of 500 nl/min at a pressure of 400 mbar comes out of the circular through hole 30C.

Advantageously, the through hole 30C is provided with a screw cap (not shown) for closing the through hole 30C when the compressor operates "in series" (FIGS. 1, 8).

In the case of FIG. 2, the air entering the through hole 30B is trapped only in the second compression stage (II) and cannot move to the first compression stage (I) because it finds along its path the back of the dividing plate 80 which, in this case, acts as a cap.

Furthermore, in the case of a connection "in parallel", a part of the air entering through the opening 70H always ends up in the channel 95, but can come out of said channel 95 always and only passing through the through hole 80H.

In other words, in the case of a connection "in parallel", the air contained in the channel 95 is substantially stagnant because the main flow of compressed air passes through the openings 70H, 80H which are in direct communication between them since, as previously stated, the two dividing plates 70, 80 are backed and packaged one on the other.

The main advantage of the two-stage volumetric compressor object of the present invention consists in the fact that, by using exactly the same components, in the assembly phase the two compression stages may establish a communication "in series" (with a low flow rate and a high prevalence) or "in parallel" (vice versa, with a high flow rate and a low prevalence).

The invention claimed is:

1. A two-stage rotary compressor (10) for a gas;

the rotary compressor (10) comprising a bottom plate (20) and a head (30), which enclose, between them, two compression stages ((I), (II));

the rotary compressor being characterised in that between said two compression stages ((I), (II)) an interconnection device (100; 100*; 100) is arranged, which is suited to establish a communication "in series" (100*) or "in parallel" (100****), to be selected by the manufacturer, between said two compression stages ((I), (II));

wherein said interconnection device (100; 100*; 100) comprises a first dividing plate (70) and a second dividing plate (80**), which are packed one on the other;

said first dividing plate (70) and said second dividing plate (80) are identical.

2. A two-stage rotary compressor (10), according to claim 1, characterised in that the two compression stages ((I), (II)) are different.

3. A two-stage rotary compressor (10) for a gas;

the rotary compressor (10) comprising a bottom plate (20) and a head (30), which enclose, between them, two compression stages ((I), (II));

the rotary compressor being characterised in that between said two compression stages ((I), (II)) an interconnection device (100; 100*; 100) is arranged, which is suited to establish a communication "in series" (100*) or "in parallel" (100****), to be selected by the manufacturer, between said two compression stages ((I), (II));

wherein said interconnection device (100; 100*; 100) comprises a first dividing plate (70) and a second dividing plate (80**), which are packed one on the other;

wherein each dividing plate (70, 80) comprises a respective main body (70A, 80A) with four respective slots (70D, 70E, 70F, 70G; 80D, 80E, 80F, 80G), and one respective opening (70H; 80H) which is associated with a respective longitudinal recess (70L; 80L).

4. A two-stage rotary compressor (10), according to claim 3, characterised in that said first dividing plate (70) and said second dividing plate (80) are identical.

5. A two-stage rotary compressor (10), according to claim 3, characterised in that the two longitudinal recesses (70L; 80L) face one another to form a channel (95).

6. A two-stage rotary compressor (10), according to claim 5, characterised in that at least a portion of said channel (95) establishes a fluid communication between an inlet opening (70H), which is provided on said first dividing plate (70), and an outlet opening (80H), which is provided on said second dividing plate (80).

7. A two-stage rotary compressor (10), according to claim 6, characterised in that, when said interconnection device (100*) is configured so as to establish a communication "in series" between said two compression stages ((I), (II)), said inlet opening (70H) is arranged in an upper part of said first dividing plate (70), whereas said outlet opening (80H) is arranged in a lower part of said second dividing plate (80).

8. A two-stage rotary compressor (10), according to claim 6, characterised in that, when said interconnection device (100) is configured so as to establish a communication "in parallel" between said two compression stages ((I), (II)), both said inlet opening (70H) and said outlet opening (80H) are arranged in respective upper parts of said first dividing plate (70) and of said second dividing plate (80**).

9. A two-stage rotary compressor (10), according to claim 8, characterised in that, when said interconnection device (100) is configured so as to establish a communication "in parallel" between said two compression stages ((I), (II)), the air is directly supplied to said second compression stage (II) by means of a through hole (30B) provided on said head (30**).

* * * * *